US007161410B2

(12) United States Patent
Rademacher

(10) Patent No.: US 7,161,410 B2
(45) Date of Patent: Jan. 9, 2007

(54) SWITCHING CIRCUIT FOR PRODUCING AN ADJUSTABLE OUTPUT CHARACTERISTIC

(75) Inventor: Markus Rademacher, Augsburg (DE)

(73) Assignee: Minebea Co., Ltd., Miyota-machi (JP)

( * ) Notice: Subject to any disclaimer, the term of this patent is extended or adjusted under 35 U.S.C. 154(b) by 0 days.

(21) Appl. No.: 10/484,554

(22) PCT Filed: Mar. 11, 2003

(86) PCT No.: PCT/EP03/02546

§ 371 (c)(1),
(2), (4) Date: Aug. 11, 2004

(87) PCT Pub. No.: WO03/079131

PCT Pub. Date: Sep. 25, 2003

(65) Prior Publication Data

(30) Foreign Application Priority Data

Mar. 20, 2002 (DE) ..... 102 12 360

(51) Int. Cl.
*G05F 1/10* (2006.01)

(52) U.S. Cl. ..... 327/540; 327/74

(58) Field of Classification Search ..... 327/74, 327/325, 327, 530, 540, 538
See application file for complete search history.

(56) References Cited

U.S. PATENT DOCUMENTS 5,484,166 A 1/1996 Mazur et al.
5,623,198 A 4/1997 Massie et al.
5,821,808 A * 10/1998 Fujima ..... 327/541
6,188,210 B1 2/2001 Tichauer et al.
6,288,526 B1 9/2001 Olah
6,492,864 B1 12/2002 Mahria
6,867,639 B1 * 3/2005 Chun ..... 327/538

OTHER PUBLICATIONS

Sipex Corporation, "2002 Short Form Catalogue," 'Online! 2001, Sipex Corporation, Taiwan XP002245541, retrieved from the Internet at: http://www.sipex.com/support/pdf/Power_sf_3.pdf, p. 133.
Astec Semiconductor, "www.ptcc.com.tw," Astec Semiconductor, Taiwan, retrieved from the Internet at: http://www.ptcc.com.tw/astec/upload/astec_12_as2431.pdf, pp. 17-24.
International Search Report for PCT/EP03/02546.

* cited by examiner

*Primary Examiner*—Long Nguyen
*Assistant Examiner*—Ryan Jager
(74) *Attorney, Agent, or Firm*—Duane Morris LLP

(57) ABSTRACT

The invention relates to a circuit to generate an output characteristic, having a constant voltage control circuit which receives a voltage supply and generates a constant output voltage; a current reduction section, which receives a control voltage and, depending on this, generates a control current which produces a change in the output voltage; and a limiter section which receives a lower and an upper limit voltage and optionally blocks or activates the current reduction section.

The invention also relates to a corresponding method to generate an output characteristic.

9 Claims, 2 Drawing Sheets

SWITCHING CIRCUIT FOR PRODUCING AN ADJUSTABLE OUTPUT CHARACTERISTIC

This application claims the filing-date benefit of PCT Application No. EP03/02546 filed Mar. 11, 2003, which in turn claims priority to German Patent Application No. 102 12 360.8 filed Mar. 20, 2002.

FIELD OF THE INVENTION

The invention relates to a circuit to generate an adjustable output characteristic and in particular a circuit to generate a variable output voltage using a constant voltage control circuit.

BACKGROUND OF THE INVENTION

In the prior art, programmable or adjustable precision reference voltage generators are known, such as the AS 2431 from ASTEC Semiconductor, a division of Emerson Electric Company, Saint Louis, Mo., USA. A programmable reference voltage generator can supply an adjustable, constant output voltage largely independent of voltage supply fluctuations, whereby such a reference voltage generator preferably has a low temperature coefficient, a precise turn-on characteristic and low output impedance. To achieve the required input voltage, the reference voltage generator is connected to external components, in particular resistors. An example of a programmable reference voltage generator is illustrated in FIG. 1.

Figure 1:
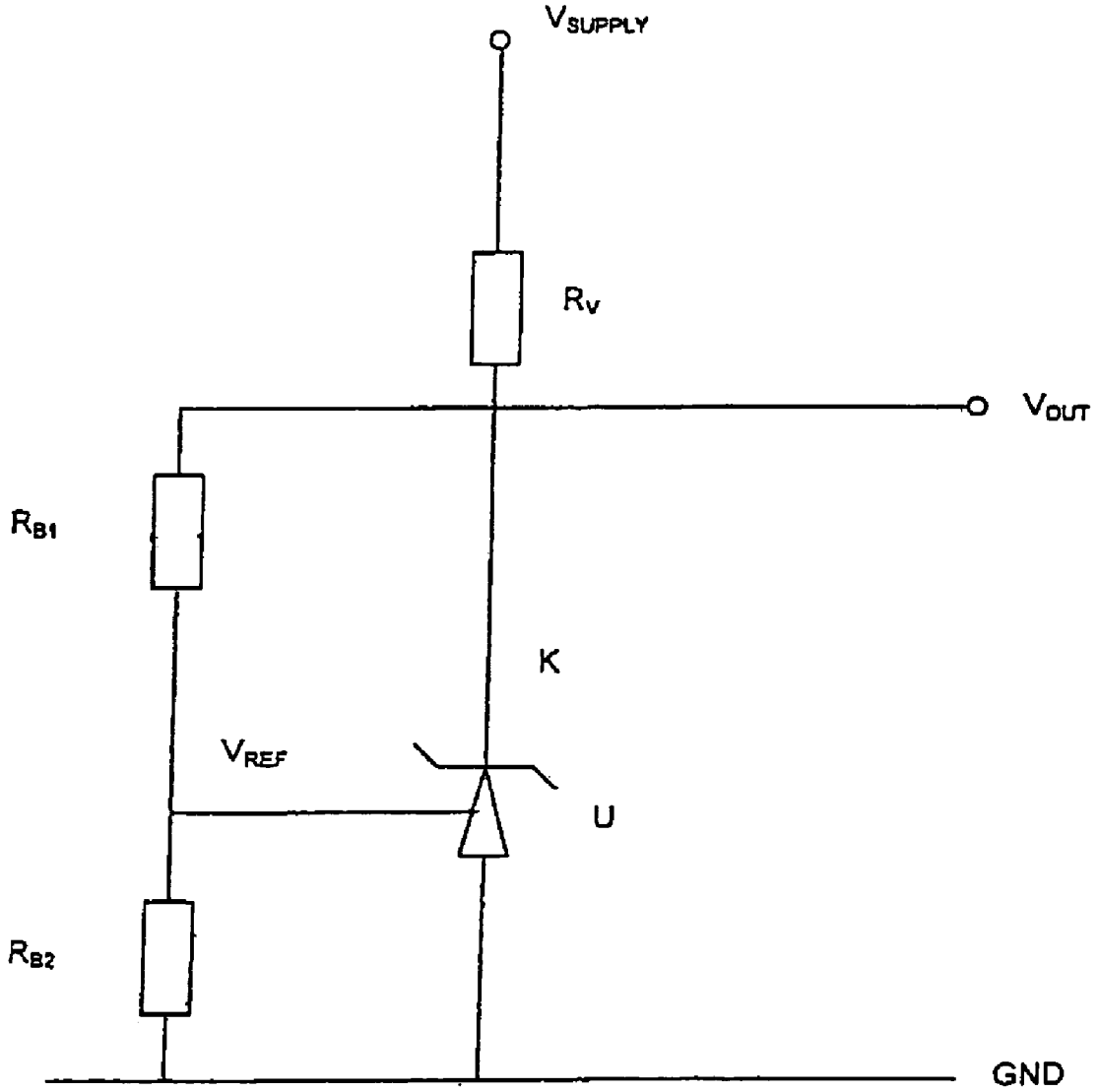

The reference voltage generator U shown in FIG. 1 is connected to a voltage supply $V_{SUPPLY}$ via a resistor $R_V$. A bridge circuit consisting of two resistors $R_{B1}$, $R_{B2}$ is connected in parallel to the reference voltage generator U. The bridge circuit comprising the resistors $R_{B1}$, $R_{B2}$ generates a defined reference voltage $V_{REF}$, adjustable via the resistors, which is applied to a reference input of the reference voltage generator U, so that a very precise, stable constant output voltage $V_{OUT}$ is produced at its cathode K or output.

Figure 2:
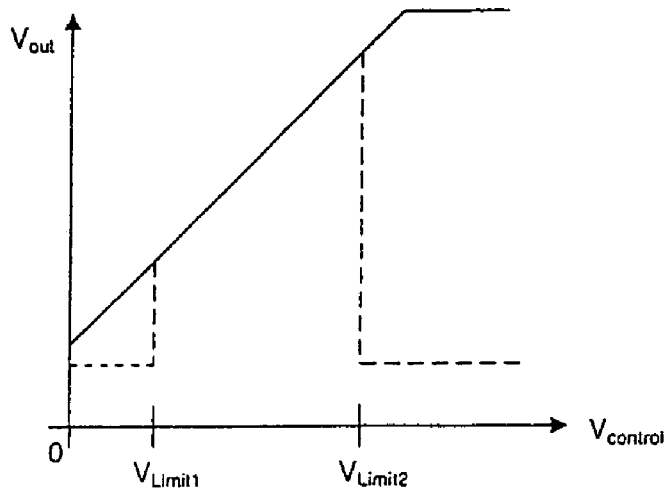

Whereas a stable, constant output voltage is required for many applications, there are other applications which need programmable or adjustable rising or falling voltage characteristics. An example of a voltage characteristic, which, for instance, is needed in power supplies for telecommunications facilities, is shown in FIG. 2. With an increasing control voltage $V_{CONTROL}$, the output characteristic illustrated in FIG. 2 rises steadily and monotonously; see the continuous line in FIG. 2. Provision can also be made for the output characteristic $V_{OUT}$ for control voltage values $V_{CONTROL}$ lying below a lower limit voltage $V_{LIMIT1}$ or above an upper limit voltage $V_{LIMIT2}$ to be cut off and restricted to a defined, low output voltage value. This results in an output voltage $V_{OUT}$ which has a constant, low value up to the lower limit voltage $V_{LIMIT1}$, which rises to a defined higher value on exceeding $V_{LIMIT1}$, rises steadily and monotonously between the lower and upper limit voltage $V_{LIMIT1}$ and $V_{LIMIT2}$ and then when the control voltage $V_{CONTROL}$ exceeds the upper limit voltage $V_{LIMIT2}$ again falls to a constant, low value, which can be the same as or different to the constant low output voltage value on turning on the control voltage $V_{CONTROL}$. Such a characteristic can be used, for example, in power supplies to charge batteries, in particular, in telecommunications systems. We would like to point out that the characteristic in FIG. 2 is only one example of an adjustable output voltage characteristic and that there are numerous applications for various adjustable output voltage characteristics in all sectors of the electrical industry.

It is thus the object of the invention to provide a device and a method to generate an adjustable, exceedingly precise output characteristic, based on a constant voltage generator. The output characteristic should be particularly suitable for power supplies, battery charging units and suchlike, and even more particularly for application in telecommunications facilities.

SUMMARY OF THE INVENTION

The above-mentioned object has been achieved by means of a circuit having the characteristics outlined in claim 1 as well as a method having the characteristics outlined in claim 14.

In accordance with the invention, a circuit to generate an output characteristic is provided that has a constant voltage control circuit which receives a voltage supply and generates a constant output voltage. This constant voltage control circuit can essentially correspond to the programmable reference voltage generator shown in FIG. 1. Moreover, the invention provides for the constant voltage control circuit to be connected to a current reduction section which receives a control voltage and, depending on this, generates a control current which produces a change in the output voltage, to produce, in particular, a monotonous, steady rise or fall in the output voltage. The invention additionally provides a limiter section, connected to the current reduction section, which receives a lower and an upper limit voltage and, depending on this, can optionally block or activate the current reduction section. The limiter section thus makes it possible to optionally switch on or off the influence on the output voltage of the constant voltage control circuit by the current reduction section.

The invention provides a simple solution in terms of design and circuitry which can be largely integrated and realized at low-cost to generate a specified, adjustable output characteristic with great accuracy and stability. The invention achieves this by using a stable, programmable reference voltage generator which generates a fixed, constant output voltage and by adding a variable current reduction circuit to make the output voltage characteristic adjustable, as well as a limiter in order to achieve a further means of influence, in particular, a cut off of the output characteristic. While the supply voltage of the circuit presented in the invention can have strong fluctuations e.g. in the region of 20%, according to the invention, an output characteristic with an accuracy of +/−0.1% to 5% can be achieved, depending on the accuracy of the components used.

According to the invention, in the constant voltage control circuit a programmable reference voltage generator is preferably used whose output voltage is adjustable using a voltage divider. For instance, the above-mentioned shunt regulator AS 2431 from ASTEC Semiconductor or a suitable component from Alpha Semiconductor or Texas Instruments, for example, can be used as a reference voltage generator. It is clear that the invention is not restricted to a specific component.

In the constant voltage control circuit of the present invention, the voltage divider is preferably divided into a first ohmic section with two resistors and a second ohmic section with one resistor to allow the adjustable output characteristic to be to be influenced with particular ease, as described below.

In a preferred embodiment, the current reduction section has a resistor which is connected in series to one of the two resistors in the first ohmic section so that the control current of the current reduction section flows through these two resistors connected in series in order to superimpose a voltage proportional to the control current on the output voltage. Depending on the design of the current reduction section, this can result in an increase or decrease in the output voltage.

The current reduction section is preferably activated via a first switching element which is contained therein in order to optionally activate or block the control current This switching element is preferably activated via the limiter section.

For this purpose, in a preferred embodiment, the limiter section can have a comparator which receives the lower and the upper limit voltage as well as the control voltage, and generates a comparator output signal. This comparator output signal activates or deactivates the current reduction section via the first switching element. In addition, the limiter section can include a bypass circuit which is also activated or blocked depending on the comparator output signal.

The limiter section is preferably designed in such a way that it deactivates the current reduction section when the control voltage is less than the lower limit voltage or greater than the upper limit voltage, and otherwise activates it Moreover, the limiter section can have a second switching element which also receives the comparator output signal and optionally activates or blocks the bypass circuit In a particularly beneficial embodiment, the bypass circuit has a resistor which is connected in parallel to one of the two resistors in the first ohmic section of the voltage divider of the constant voltage control circuit The bypass circuit is activated when the control voltage is less than the lower limit voltage or greater than the upper limit voltage, and is otherwise blocked. This means that, for control voltages which lie outside the interval between the lower and the upper limit voltage, the output characteristic of the circuit can be lowered to a defined constant voltage value. Of course, it is possible through an appropriate modification of the limiter circuit, by providing, for example, a series connection instead of the parallel connection of the bypass circuit, to raise the output voltage of the circuit to a defined constant value.

The invention also provides a method to generate an output characteristic with the following procedural steps: generating a constant output voltage depending on a voltage supply and a reference voltage; generating a control current depending on a control voltage and changing the output voltage depending on the control current; and optionally activating or blocking the control current depending on whether the control voltage lies within or without an interval between a lower and an upper limit voltage.

The invention is explained in more detail below based on a preferred embodiment and with reference to the drawings. In reading the following description, the technician will easily recognize that numerous modifications can be made to the illustrated circuit, particularly to generate a different characteristic to the one illustrated in FIG. 2, without departing from the scope of the invention. The figures show:

SHORT DESCRIPTION OF THE DRAWINGS

Figure 3:
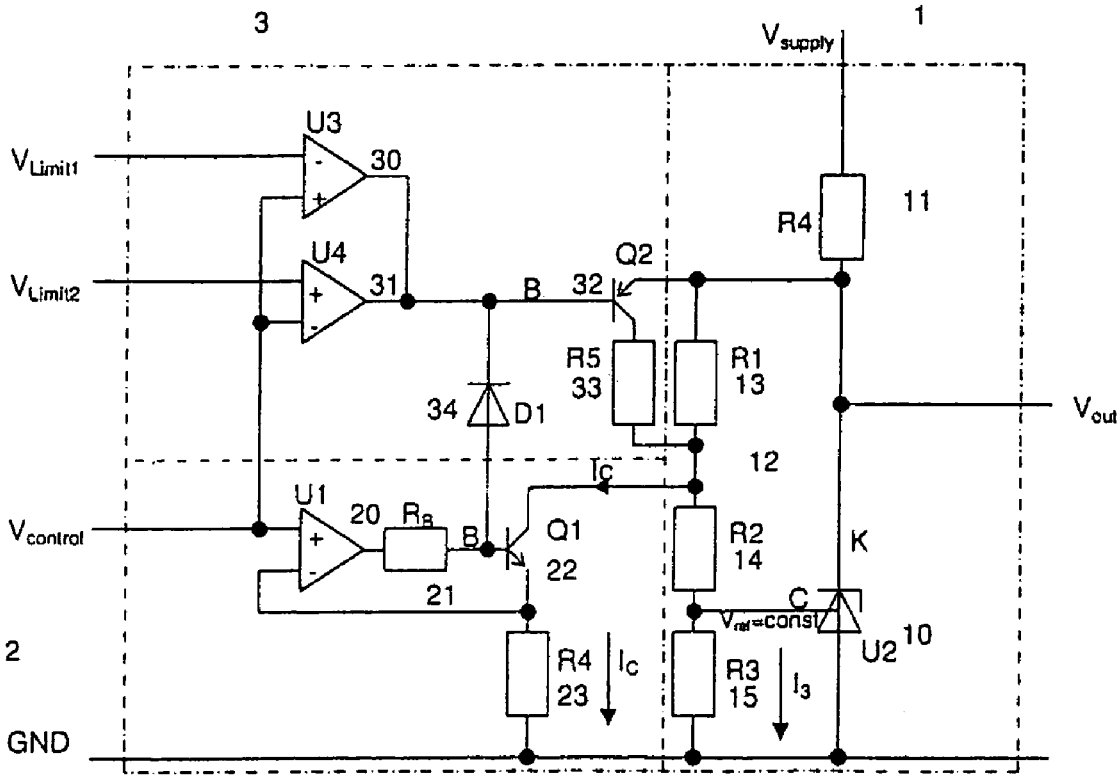

FIG. 1 a circuit diagram of an interconnected programmable reference voltage generator in accordance with the prior art;

FIG. 2 an output characteristic of a circuit in accordance with the invention; and FIG. 3 a circuit diagram of a circuit to generate an output characteristic in accordance with the invention.

DETAILED DESCRIPTION OF PREFERRED EMBODIMENTS

FIG. 3 shows a preferred embodiment of a circuit to generate the output characteristic which is illustrated in FIG. 2. The circuit basically consists of three sections, a constant voltage control is circuit 1, a current reduction section 2 and a limiter section 3.

The constant voltage control circuit 1 is designed in a similar way to the programmable reference voltage generator which is illustrated in FIG. 1. The constant voltage control circuit 1 features a reference voltage generator 10, U2, which is connected to a voltage supply $V_{SUPPLY}$ via a resistor 11, R4. A voltage divider 12 is connected in parallel to the reference voltage generator 10 which has a first ohmic section with two resistors 13 and 14, R1 or R2, and a second ohmic section with one resistor 15, R3. The reference voltage generator 10, which, in practice, is also referred to as a programmable shunt regulator, generates a very precise and stable, constant output voltage $V_{OUT}$ at its output or cathode K which is dependent on a reference voltage $V_{REF}$ at the control input C of the reference voltage generator U2. The reference voltage $V_{REF}$ is adjusted by the voltage divider 12 and, in particular, by the relationship of the first ohmic section 13, 14 to the second ohmic section 15. The output voltage $V_{OUT}$ of the constant voltage control circuit 1 alone, without taking into account the current reduction section 2 and the limiter section 3, is dependent on the current $I_3$ flowing through the resistor 15, R3, in accordance with the following equation:

$$V_{OUT}=I_3*(R1+R2+R3)$$

The constant voltage control circuit 1 thus generates the constant output voltage $V_{ouT}$ defined above.

In order to generate an adjustable, rising or falling output characteristic based on this output voltage, the current reduction section 2 is added to the constant voltage control circuit 1. The current reduction section 2 includes an operational amplifier 20, U1, whose output is connected to the control input B of an electronic switching element 22, Q1, via a base resistor 21, $R_B$. The electronic switching element 22 can take the form, for example, of a bipolar npn transistor or a field effect transistor. The electronic switching element 22 is connected in series to a current reduction resistor 23, R4, and this series connection 22, 23 is connected in parallel to the resistors 14, 15 of the voltage divider 12 of the constant voltage control circuit 1. The operational amplifier 20 receives a control voltage $V_{CONTROL}$ at its (+) input, its other (−) input is connected to the connection point between the electronic switch 22 and the resistor 23.

As soon as a control voltage $V_{CONTROL}$ is applied to one (+) input of the operational amplifier 20, the amplifier generates an output signal which is applied via the base resistor 21 to the control input B of the electronic switch 22. The electronic switch 22 is closed by this and a control current $I_C$ flows through the electronic switch 22 and the current reduction resistor 23, as illustrated in FIG. 3. Since the reference voltage $V_{REF}$ at the control input C of the reference voltage generator 10 is always constant, the current $I_3$ through the resistor 15, R3, and thus also through the resistor 14, R2, also remains constant Consequently, the control current $I_C$ has to be taken from the constant voltage control circuit 1 through the resistor 13, R1. The control current $I_C$ thus produces an additional drop in voltage at the resistor 13, R1 which is proportional to the control voltage $V_{CONTROL}$. This additional voltage drop is superimposed on the output voltage $V_{OUT}$ and generates an output voltage characteristic depending on the control voltage $V_{CONTROL}$, shown in FIG. 2 as a continuous line. Taking into account the constant voltage control circuit 1 and the current reduction section 2, the output voltage $V_{OUT}$ results in:

$$V_{OUT}=(I_3+I_C)*R1+I_3*(R2+R3),$$

whereby $I_3$*(R1+R2+R3) is constant and $I_C$ is variable depending on the control voltage $V_{CONTROL}$.

If the resistor 23 is made the same size as the resistor 13, R4=R1, a voltage drop, R4*$I_C$, is produced at resistor 23, R4 which is equal to the voltage rise of the output characteristic $V_{OUT}$. In the embodiment illustrated, the accuracy with which the output characteristic $V_{OUT}$ can be adjusted corresponds to the accuracy of the control voltage $V_{CONTROL}$. The operational amplifier 20 and the base resistor 21 are used in particular to de-couple the control voltage $V_{CONTROL}$, whereby the technician will be able to conceive of other suitable embodiments to interconnect the current reduction circuit.

To further modify the characteristic, represented in FIG. 2 by a continuous line, particularly to cut it off, as represented in FIG. 2 by a broken line, the limiter section 3 shown in FIG. 3 is added to the constant voltage control circuit 1 and the current reduction section 2. The limiter section 3 includes two operational amplifiers 30 U3, and 31, U4 which operate as comparators, as well as another electronic switching element 32, Q2, a bypass resistor 33, R5, and a diode 34, D1. The two operational amplifiers 30, 31 receive a lower limit voltage $V_{LIMIT1}$ or an upper limit voltage $V_{LIMIT2}$ at their negative (−) or positive (+) input as well as the control voltage $V_{CONTROL}$ at the other (+/−) input, respectively. The output of both operational amplifiers 30, 31 is led to a control input B of the electronic switch 32. The electronic switch 32 can be designed, for example, as a bipolar transistor, particularly as a pnp transistor, or as a field-effect transistor or suchlike. Together with the bypass resistor 33, the electronic switch 32 forms a bypass circuit which is connected in parallel to the resistor 13 of the voltage divider 12 of the constant voltage control circuit 1. As illustrated in FIG. 3, the diode 34 connects the control inputs B of the first and second electronic switching elements 22, 32 and causes the first electronic switching element 22 of the current reduction section 2 to be blocked when the second electronic switching element 32 of the limiter sections is activated.

The limiter section 3 operates as follows:

When the control voltage $V_{CONTROL}$ lies in the interval between the lower and the upper limit voltage $V_{LIMIT1}$, $V_{LIMIT2}$, $$V_{LIMIT1}<V_{CONTROL}<V_{LIMIT2}$$

there is a positive voltage difference at the inputs of the operational amplifiers 30, 31, so that their output becomes high ohmic which corresponds to a positives signal level (1). This signal is applied to the control input B of the electronic switch 32, so that the electronic switch 32, Q2, in the embodiment illustrated a pnp transistor, blocks and thus the limiter section 3 is not active; i.e. the bypass resistor 33 is de-activated and the limiter section 3 has also no influence on the current reduction section 2.

When $$V_{CONTROL}<V_{LIMIT1}$$

there is a negative voltage difference at the input of the operational amplifier 30, so that the output of the operational amplifier 30 becomes low ohmic and thus goes to a lower voltage is level (0). This lower voltage level (0) is applied to the control input B of the switching element 32, in the illustrated embodiment a pnp transistor, which becomes conductive. Thus a current flows in the branch connected in parallel to the resistor 13, R1, which includes a second switching element 32 and the bypass resistor 33, R5, whereby the total resistance value of the parallel connection of the resistors 13, 33, as the technician will be aware, is less than the resistor value R1 of the resistor 13 alone, so that all in all the output voltage $V_{OUT}$ drops to a lower value.

At the same time, the current reduction section 2 is blocked or deactivated via the diode 34 and the first electronic switch 22, so that no current (IC) flows through the electronic switch 22 and the current reduction resistor 23. Thus, at the output of the current circuit there is a constant lower voltage level $V_{OUT}$, as represented by the broken line in FIG. 2.

$$V_{OUT}=I_3*(R1//R5+R2+R3)$$

A similar circuit behavior results for $$V_{CONTROL}>V_{LIMIT2}.$$

In this case, there is a negative voltage difference at the input of the operational amplifier 31, U4, which results in the output of the operational amplifier 31 becoming low ohmic and going to a lower voltage level (0). This also makes the electronic switch 32 conductive, so that the bypass resistor 33 is activated and the current reduction section 1 is blocked via the diode 34, as described above.

The design of the limiter circuit 2 as presented in the invention, allows an output voltage characteristic of the entire circuit to be set which, at specific value limits, jumps to specific is voltage values, whereby the voltage values are determined by the connection in parallel of the resistors 13 and 33, R1 or R5, on the one hand and also by the resistors 13 and 23, R1 and R4 on the other hand. The broken line in FIG. 2 shows the complete output characteristic when all three sections 1, 2, 3 of the circuit of the invention are in operation. Such a characteristic is typical, for example, for battery chargers e.g. in telecom applications.

The characteristics revealed in the above description, the claims and the figures can be important for the realization of the invention its various embodiments both individually and in any combination whatsoever.

IDENTIFICATION REFERENCE LIST

| | |
|---|---|
| 1 | Constant voltage control circuit |
| 2 | Current reduction section |
| 3 | Limiter section |
| 10 | Reference voltage generator U2 |
| 11 | Resistor R4 |
| 12 | Voltage divider |
| 13 | Resistor R1 |
| 14 | Resistor R2 |
| 15 | Resistor R3 |
| 20 | Operational amplifier U1 |
| 21 | Base resistor $R_B$ |
| 22 | Electronic switch Q1 |
| 23 | Current reduction resistor R4 |
| 30 | Operational amplifier, comparator U3 |
| 31 | Operational amplifier, comparator U4 |
| 32 | Electronic switch Q2 |
| 33 | Bypass resistor R5 |
| 34 | Diode D1 |

The invention claimed is:

1. A circuit for generating an output voltage ($V_{out}$) comprising:

a constant voltage control circuit (1) which receives a voltage supply ($V_{SUPPLY}$) and generates the output voltage ($V_{OUT}$);

a current reduction section (2) which receives a control voltage ($V_{CONTROL}$) and generates a control current ($I_C$) which produces a change in the output voltage ($V_{OUT}$); and a limiter section (3) which receives a lower and an upper limit voltage ($V_{LIMIT1}$, $V_{LIMIT2}$) and blocks or activates the current reduction section (2) responsive to the control voltage ($V_{CONTROL}$);

wherein the constant voltage control circuit (1) further comprises a programmable reference voltage generator (10) wherein output voltage ($V_{OUT}$) can be adjusted via a voltage divider (13, 14, 15); and wherein the voltage divider (13, 14, 15) includes a first ohmic section with two resistors (13, 14) and a second ohmic section with one resistor (15).

2. The circuit according to claim 1, wherein the current reduction section (2) further comprises a resistor (23) which is connected in series to one (13) of the two resistors in the first ohmic section so that the control current ($I_C$) flows through the one resistor (23) of the current reduction section and through one (13) of the two resistors in the first ohmic section in order to superimpose a voltage ($I_C \cdot R1$) proportional to the control current ($I_C$) on the output voltage ($V_{OUT}$).

3. The circuit according to claim 1, wherein a bypass circuit (32, 33) comprises a resistor (33) which is connected in parallel to one (13) of the two resistors in the first ohmic section via a second switching element (32).

4. A circuit for generating an output voltage ($V_{OUT}$) comprising:

a constant voltage control circuit (1) which receives a voltage supply ($V_{SUPPLY}$) and generates the output voltage ($V_{OUT}$);

a current reduction section (2) which receives a control voltage ($V_{CONTROL}$) and generates a control current ($I_C$) which produces a change in the output voltage ($V_{OUT}$); and a limiter section (3) which receives a lower and an upper limit voltage ($V_{LIMIT1}$, $V_{LIMIT2}$) and blocks or activates the current reduction section (2) responsive to the control voltage ($V_{CONTROL}$);

wherein the limiter section (3) comprises a comparator (30, 31) which receives the lower and the upper limit voltage ($V_{LIMIT1}$, $V_{LIMIT2}$) as well as the control voltage ($V_{CONTROL}$), and generates a comparator output signal and wherein the limiter section (3) blocks or activates the current reduction section (2) as a function of the comparator output signal; and wherein the comparator output signal of the limiter section (3) is connected to a first switching element (22) of the current reduction section (2) to activate or block the control current ($I_C$).

5. The circuit according to claim 4, wherein the comparator output signal is connected to the first switching element (22) via at least one diode (34).

6. The circuit according to claim 4, wherein the first switching element (22) blocks the control current ($I_C$) when the control voltage ($V_{CONTROL}$) is less than the lower limit voltage ($V_{LIMIT1}$) or greater than the upper limit voltage ($V_{LIMIT2}$).

7. The circuit according to claim 4, wherein the first switching element (22) activates the control current ($I_C$) when the control voltage ($V_{CONTROL}$) is substantially between the lower limit voltage ($V_{LIMIT1}$) and the upper limit voltage ($V_{LIMIT2}$).

8. The circuit according to claim 4, wherein the bypass circuit (32, 33) comprises a resistor (33) which is connected in parallel to one (13) of a plurality of resistors in a first ohmic section via the second switching element (32).

9. The circuit according to claim 8, wherein the second switching element (32) activates the bypass circuit (32, 33) when the control voltage ($V_{CONTROL}$) is less than the lower limit voltage ($V_{LIMIT1}$) or greater than the upper limit voltage ($V_{LIMIT2}$).

* * * * *